US006531183B1

(12) United States Patent
Cason et al.

(10) Patent No.: US 6,531,183 B1
(45) Date of Patent: Mar. 11, 2003

(54) METHOD OF PRODUCING HIGH GLOSS PAPER

(75) Inventors: David B. Cason, Paducah, KY (US); S. Craig Petro, Paducah, KY (US); Stig V. Renvall, Silver Spring, MD (US); Bhima S. Sastri, North Potomac, MD (US)

(73) Assignee: MeadWestvaco Corporation, Stamford, CT (US)

( * ) Notice: Subject to any disclaimer, the term of this patent is extended or adjusted under 35 U.S.C. 154(b) by 67 days.

(21) Appl. No.: 09/656,348

(22) Filed: Sep. 6, 2000

Related U.S. Application Data

(63) Continuation-in-part of application No. 09/362,141, filed on Jul. 28, 1999, now abandoned.

(51) Int. Cl.[7] ..... B05D 3/12

(52) U.S. Cl. ..... 427/361; 427/365; 427/366; 162/136; 162/184; 162/206

(58) Field of Search ..... 427/361, 365, 427/366; 162/135, 136, 168.1, 184, 206

(56) References Cited

U.S. PATENT DOCUMENTS

| | | | | |
|---|---|---|---|---|
| 3,124,480 A | | 3/1964 | Mahoney et al. | 118/60 |
| 4,010,307 A | | 3/1977 | Canard et al. | 428/327 |
| 4,624,744 A | | 11/1986 | Vreeland | 162/206 |
| 4,670,102 A | | 6/1987 | Maurer | 162/361 |
| 5,118,533 A | | 6/1992 | Saji et al. | 427/366 |
| 5,283,129 A | | 2/1994 | Renk et al. | 428/537 |
| 5,360,657 A | | 11/1994 | Kano et al. | 428/207 |
| 5,438,920 A | | 8/1995 | Koivukunns et al. | 100/38 |
| 5,902,453 A | | 5/1999 | Ruch | 162/135 |
| 6,242,047 B1 | * | 6/2001 | Johnson et al. | 427/361 |
| 6,254,725 B1 | | 7/2001 | Lau et al. | 162/135 |

FOREIGN PATENT DOCUMENTS

| | | |
|---|---|---|
| CA | 2238466 | 5/1998 |
| CA | 2238466 | 12/1998 |
| WO | 9820201 | 5/1998 |
| WO | WO 99/63157 | * 12/1999 |

OTHER PUBLICATIONS

"Rubber Roll Hardness—Another Look", by H. L. Schmidlin and Raybestos–Manhattan, Inc. Pulp & Paper Mar. 18, 1968, pp. 30–32.

"Lightweight Coated Magazine Papers", Published in Paper Magazine, vol. 186, No. 1, 1976, pp. 35–38. (No Month Date).

"Calculation of Nip Width, Penetration, and Pressure for Contact between Cylinders with Elastomeric Covering", Narayan V. Deshpande, Tappi, Oct. 1978, vol. 61, No. 10, pp. 115–118.

"Plastic Pigments in Paper Coatings", by D. Alince and P. Lepoutre, Published in Tappi, May 1980, vol. 63, No. 5, pp. 49–53.

"Hollow–Sphere Polymer Pigment in Paper Coating", by J. E. Young, Published in Tappi, May 1985, vol. 68, No. 5, pp. 102–105.

"Supercalendering and Soft Nip Calendering Compared", by J. D. Peel, Published in Tappi, Oct. 1991, pp. 179–186.

"Light Reflectance of Spherical Pigments in Paper Coatings", by J. Borch and P. Lepoutre, Published in Tappi, vol. 61, No. 2, pp. 45–48. (No Month Date).

* cited by examiner

*Primary Examiner*—Katherine A. Bareford
(74) *Attorney, Agent, or Firm*—D. L. Brown

(57) ABSTRACT

A method of forming a finished paper having high gloss while maintaining high bulk, comprising applying on a surface of a base stock at least one layer of a coating formulation comprising a particulate plastic pigment; and passing the base stock through a multi-nip calender device maintained at relatively low roll temperature and nip pressure. The product formed using this coating formulation and process is of high gloss quality, yet maintains a relatively high bulk, in comparison to high gloss papers produced by conventional methods.

13 Claims, 4 Drawing Sheets

METHOD OF PRODUCING HIGH GLOSS PAPER

This application is filed as a continuation-in-part of application Ser. No. 09/362,141, filed Jul. 28, 1999 now abandoned, the entire disclosure of which is herein incorporated by reference.

TECHNICAL APPLICABILITY AND FIELD OF INVENTION

The present invention relates to a method of manufacturing a high-gloss, high-bulk paper product using a coating material comprising a particulate plastic pigment. The method of the invention permits calendering a base stock coated with such a coating material at lower roll temperatures than used in conventional gloss or soft calenders, and at lower nip loads than used in conventional supercalenders. As a result, densification of the resulting coated paper product is reduced, and a product having high gloss is obtained.

BACKGROUND OF THE INVENTION

In papermaking, the finishing operation may be a calendering process, in which a paper web is passed between the nips formed between one or more pairs of rolls and the surface of the web is thereby flattened to form a smooth surface. Simultaneously, the thickness, or caliper, of the paper web is reduced and the web is densified. The density of the resulting product is usually calculated as:

Density=Basis Weight/Caliper where the basis weight is the weight of a ream, in pounds, and the caliper is the thickness of the web, measured in thousandths of an inch, or points. Calendering generally reduces caliper, and, as a result, a higher density is obtained in the finished paper product. Bulk is inversely related to density, therefore when the density is increased, the bulk of the finished paper product will be reduced.

Calendering may generally be accomplished using a gloss calender, soft calender or supercalender. The gloss calender is typically comprised of a hard, non-resilient, heated roll made, for example, of steel, positioned proximally to a soft roll so as to form a narrow gap or nip. As the web passes through the nip it is exposed to a nip load in the range of from about 100 to about 900 pounds per lineal inch (pli). Nip pressures in this type of device are usually in the range of less than about 2000 pounds per square inch (psi). A wide range of processing temperatures can be used in a gloss calender, with the typical maximum temperature being in the range of about 450° F. U.S. Pat. No. 5,118,533, for example, discloses a gloss calender in which the metal roll is held at a temperature of about 100–500° C. (212–932° F.). This temperature produces a high gloss finish on the surface of the web as it is passed through the nip, while the lower pressure used in a gloss calender causes less densification of the web, in comparison to a conventional supercalender.

The finishing effect achieved using the gloss calender, however, is not as smooth or as flat, and therefore not as glossy, as the surface produced using an apparatus capable of applying higher pressure. It is therefore often useful to increase the nip load or the roll temperature, or both, to plasticize and smooth the surface layers of the paper. Such modifications are incorporated, for example, in the design and operation of the conventional soft calender. The soft calender is usually constructed as having one to two nips per coated side, or as a two- or four-nip device, with each nip being formed between a heated hard roll and an unheated soft roll.

Alternatively, supercalendering may be used as the finishing operation. In such a process, the web is sequentially passed between a series of nips formed between the vertically stacked rolls of a supercalender. The supercalender typically comprises a frame having an upper roll and a lower roll between which are positioned intermediate rolls. The rolls of the supercalender may be heated hard rolls or unheated soft rolls, in serial or alternating arrangement. The nips formed between the rolls are typically shorter than those of a soft calender or gloss calender. The maximum temperature of the heated rolls in the supercalender is usually up to about 250° F. As the web is passed through each nip, the web is compacted to form paper of substantially uniform density and high gloss by virtue of the repeated pressurization and heat exposure. The high pressure however also causes a reduction in bulk. In a supercalender, the nips are loaded initially by gravity, i.e., gravitational forces acting on the weight of the rolls themselves produce a distribution of the weight from the upper nip to the bottom nip that is substantially linear and increasing. This has the consequence that the load present in the bottom nip actually determines the minimum loading capacity of the calender.

Some paper and paperboard grades are sold by area, and, accordingly, a lower density sheet will give more surface area per ton of paper, which is advantageous for both the manufacturer and the end user. Thus it will be appreciated that a manufacturing method that will provide the desired surface finish on the base stock without substantially affecting its bulk is desirable. Where it is desirable to maintain more bulk in the finished product, using a conventional supercalender has typically been a disadvantage because such a process requires relatively high initial nip loads and corresponding nip pressures, which are at least maintained and, more often, increased as the web moves through the series of rolls. In this regard, a typical 10–12 roll supercalender device will produce a minimum load on the bottom nip in excess of about 1000 pli which could translate to a nip pressure greater than about 2500 psi depending upon the nip width. Moreover, in order to achieve some calendering potential from the upper nips, additional external load must be applied. For example, where the initial nip load may be about 1000 pounds per linear inch (pli) as the web enters the first nip, it is then exposed to subsequent nip loads at each of the successive intervening nips before passing through a final nip at a cumulative nip load of about 2000–3000 pli, which reflects the mass of each of the preceding rolls. As a result of this amount of pressurization in combination with heat, the web is highly densified to form a paper product having a high gloss surface. Since the pressure created by the extra loading at the nip is an important factor in achieving high gloss and smoothness, the result is a good finish for the web, but at the expense of an increase in density and loss of bulk.

In high throughput finishing operations, it is generally more efficient to use a supercalender to achieve the desired high gloss effect. However, as mentioned above, using the conventional supercalender exposes the base stock to linearly rising nip loads that may result in a glossy but highly densified product of reduced bulk. For example, U.S. Pat. No. 4,624,744 discloses a process that involves finishing a paper web at a nip pressure of at least about 2000 psi using a smooth metal finishing roll and a resilient backing roll, wherein the metal finishing roll is heated to a temperature sufficient to mold the web beneath its surface, generally referred to as substrata thermal molding. A comparison between supercalendering and gloss calendering is reported in the article entitled "Supercalendering and Soft Nip Calendering Compared", by John D. Peel, TAPPI Journal, October 1991, pp. 179–186.

A recent development in the calendering art addresses the problem of increasing linear loads at the successive nips in a supercalender. U.S. Pat. No. 5,438,920 describes a modified calender which is comprised of a series of rolls similar to a conventional supercalender, but in which the loading at each nip can be controlled by way of relief means that partially or completely relieve the nip loads produced by the masses of the intermediate rolls. In this regard, as the web passes through this calender, there is less variation in the nip load and nip pressure that is applied at each nip. As a result, there is less reduction in the bulk of the finished paper. This patent does not, however, teach or suggest making a high gloss paper of reduced bulk. Laid-open Canadian Patent Application 2238466AA, filed Dec. 20, 1998, teaches using another type of modified calender with reduced nip loads at each nip to make an ultra-light weight coated (ULWC) paper, which is a high-bulk glossed paper.

It is known in the papermaking art that various coating formulations and coating ingredients may be used in the manufacture of paper to achieve high gloss. For example, U.S. Pat. No. 5,283,129 discloses a lightweight paper stock that is coated with a pigment composition including delaminated clay, calcined clay and titanium dioxide, wherein up to about 5 parts by weight of hollow core opacifying plastic pigment may be substituted for the titanium dioxide. U.S. Pat. No. 4,010,307 discloses a high gloss coated paper product comprising 70–95% calcium carbonate and from 5–30% by weight of a non-film forming polymeric pigment having particles sized within the range of from 0.05–0.30 microns. U.S. Pat. No. 5,360,657 discloses a high gloss paper prepared by a rocess wherein a thermoplastic polymeric latex having a second order transition temperature of at least about 80° C. (176° F.), and an average particle size smaller than 100 microns, is applied to paper that is subsequently calendered. Laid-open Canadian Patent Application CA 2238466AA describes the manufacture of an ultra light weight (ULWC) paper by applying a coating containing 4 or more parts per 100 parts of a plastic coating pigment onto a base paper containing 60% weight or more mechanical pulp. The coated paper is calendered at a nip loading less than conventional supercalendering nip loading, to produce a product having a bulk factor above 51 if a supercalender is used, and a bulk factor above 60 if a hot-soft calender is used. The maximum TAPPI 75° gloss achieved for ULWC paper using the invention of CA 2238466AA was reported as 35, while the inventors reported producing lightweight coated paper of lesser bulk having a maximum gloss value of 45. PCT published application WO 98/20201 discloses that a printing paper having high brightness and gloss can be manufactured by applying to paper a coating comprising at least 80 parts precipitated calcium carbonate and at least 5 parts of an acrylic styrene copolymer hollow sphere plastic pigment, based on 100 parts total weight of pigment, before finishing the coated paper to achieve gloss development. The finishing process does not involve using a modified supercalender, and the resulting paper is not taught as being a high bulk product. Hollow sphere pigments have also been used to produce a non-gloss finish. U.S. Pat. No. 5,902,453 teaches applying a coating containing 30–60% weight hollow sphere particle pigments and 40–70% weight cationic starch binder to a web, then calendering, under unspecified conditions, to yield a product with an uncoated appearance rather than a gloss finish. In an article entitled "Lightweight Coated Magazine Papers," published in the Jul. 5, 1976 issue of the magazine PAPER, Vol. 186, No. 1, at pages 35–38, a relationship between calendering and the use of plastic pigments in coatings is disclosed. The article notes, for example, that polymers such as polystyrene are thermoplastic and pressure sensitive, and a pigment based on polystyrene will exhibit a high degree of calendering response. Other publications, including the articles entitled "Light Reflectance of Spherical Pigments in Paper Coatings," by J. Borch and P. Lepoutre, published in TAPPI, February 1978, Vol. 61, No. 2, at pages 45–48; "Plastic Pigments in Paper Coatings," by B. Aluice and P. Lepoutre, published in TAPPI, May 1980, Vol. 63, No. 5, at pages 49–53; "Hollow-Sphere Polymer Pigment in Paper Coating," by J. E. Young, published in TAPPI, May 1985, Vol. 68, No. 5, at pages 102–105, all recognize the use of polymer pigments in paper coatings.

The foregoing references disclose making paper using polymeric coatings where the finishing means is a conventional calendering process, wherein high heat and/or high pressure are needed to produce a high gloss product; or, alternatively, as in CA application 2238466AA, a high bulk ULWC product of relatively low gloss is produced. A need exists, however, for a method of manufacturing paper or paperboard products in a supercalendering operation that reduces the loss of bulk and at the same time provides the finished product with a high gloss surface.

SUMMARY OF THE INVENTION

The need apparent in the art is met by the present invention, which provides a finishing method for paper and paperboard products that maintains bulk, to be used in combination with a coating formulation that provides high gloss and a smooth surface. The resulting calendered product is a high gloss paper or paperboard having an increased bulk-to-weight ratio.

In particular, the present invention relates to a method of producing a finished paper or paperboard having high gloss and high bulk, comprising:

a) forming a base stock;

b) applying to at least one side of the base stock a first layer of a coating formulation comprising a particulate plastic pigment to form a coated base stock; and c) passing the coated base stock through the nips of a multi-nip calender device; wherein said calender device is comprised of one or more hard rolls and one or more soft rolls in linear arrangement, the interface between each pair of rolls forming a nip; wherein said calender device maintains a nip load at the initial nip of about 1000 pli or less, a nip load at each of the intervening nips of up about 1000 pli or less; and a nip load at the final nip of about 1000 pli or less; and wherein the surface temperature of the one or more hard rolls does not exceed about 450° F.;

to form a product having a TAPPI 75° gloss value of greater than 60 and a density of from about 15.5 pounds per ream per caliper point (lbs./ream/pt) to about 20 lbs./ream/pt, which corresponds inversely to a basis weight of about 50 lbs./ream to about 150 lbs./ream.

In another aspect, the invention relates to a high gloss paper product comprised of a paper base stock and a coating that includes a vacuolated particulate plastic pigment, having a density of from about 15.5 lbs./ream/pt to about 20 lbs./ream/pt, which corresponds inversely to a basis weight of from about 50 to about 150 lbs./ream, wherein the ream size is approximately 3300 $ft^2$. Such densities are approximately 1–2 lbs./ream/pt lower than is typically accomplished using the same base stock material under conventional calendering methods at constant gloss levels. The products of the invention typically demonstrate a TAPPI 75° gloss value of greater than about 60.

DETAILED DESCRIPTION OF THE PREFERRED EMBODIMENTS OF THE INVENTION

Figure 1A:
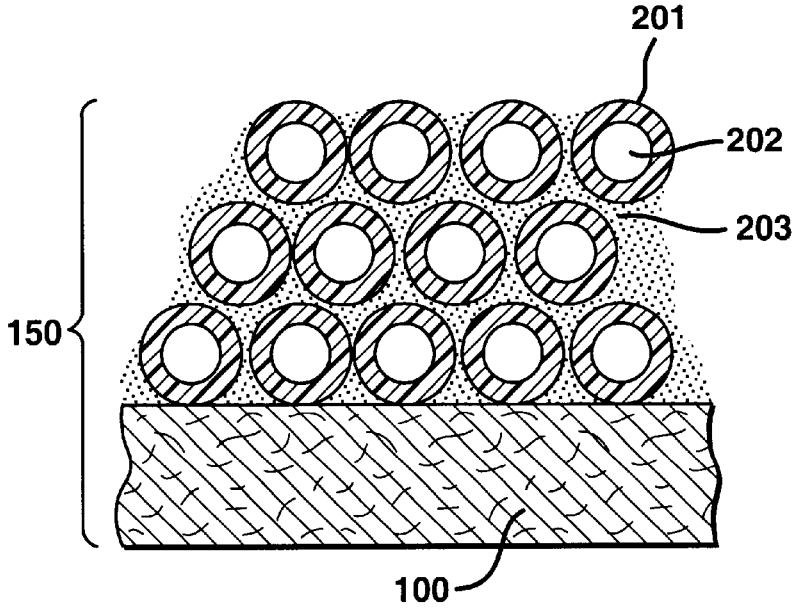
FIG. 1*a* is a cross-sectional representation of a base stock coated with a layer of a coating formulation comprised of hollow polymer pigment particles according to the invention.

The finishing method of the invention produces a paper product having a relatively high bulk, therefore producing a thicker sheet of reduced density or compaction, while maintaining a smooth, high gloss surface. As used herein, "paper product" includes all varieties of finished paper or paperboard materials. The term "high gloss" means a TAPPI gloss value of greater than 60, as determined at a 75° angle of reflectance.

In the method of the present invention, a coating formulation is applied to the surface of a base stock before finishing. The "base stock" may be a dried web or sheet or material otherwise formed from a paper furnish comprised of wood pulp and, optionally, other additives. Preferably, the pulp is a comprised mainly of chemical pulp, but the furnish may contain, if desirable, other types of pulp including mechanical pulp, semi-chemical pulp, recycled pulp, pulp containing other natural fibers, synthetic fibers, and any combination thereof. The paper or paperboard products of the present invention typically, however, contain less than 60% by weight of mechanical pulp. The base stock may be of any suitable fiber composition having a uniform dispersion of cellulosic fibers alone or in combination with other fiber materials, such as natural or synthetic fiber materials. Examples of suitable substrates include previously coated or uncoated paper or paperboard stock of a weight ranging from about 37 to about 115 lbs./ream. For example, the substrate may be a 115 lbs./ream paper stock manufactured by Westvaco Corporation.

The coating formulation suitably comprises a vacuolated or solid particulate plastic pigment. During the finishing process, the surfaces of the particulate plastic pigment are compacted into an orientation parallel to the plane of the surface of the base stock. The surfaces of the polymer particles provide a smooth layer and therefore increase reflectance of light, and, accordingly, glossiness of the coated, finished surface. While solid particulate plastic pigments may be used, preferably, the plastic pigment is comprised of vacuolated particles of a suitable polymer material. The term "vacuolated" means that the pigment particles include one or more hollow voids or vacuoles within the particle. For example, the particle may be formed with a single void at its core, as a hollow sphere, or it may include several voids. When the vacuolated particles are pressed during a finishing operation such as calendering, the vacuoles are not completely flattened, and accordingly, a higher bulk is retained after compaction than would be achieved using a non-particulate pigment, or after using a pigment in the form of solid particles without voids. The particulate plastic pigment used is suitably of a size to permit the desired gloss development, the particle diameter being restricted only by the limitations of the process used in manufacturing the pigment, and any limitations imposed by printing requirements for the paper product. Particle sizes may therefore be 0.1 micron or more in diameter, for example, up to or exceeding about 1.0 micron.

Suitable vacuolated pigments include polystyrenes and acrylic polymers, including, but not limited to, methyl-methacrylate, butyl-methacrylate and alphamethyl styrene. The particulate plastic pigment may be used as a latex, preferably in an aqueous medium. An example of a particulate pigment is "HP-1055", which is a hollow sphere pigment commercially available from Rohm & Haas. This pigment is made of styrene-acrylic copolymer, and has a particle diameter of about 1.0 micron.

The amount of particulate plastic pigment in the coating formulation may range from about 10 parts by weight to about 50 parts by weight, based on the total dry weight of pigment. Preferably, the amount of particulate plastic pigment used is from about 14 parts by weight to about 25 parts by weight, based on the total dry weight of pigment.

Optionally, the coating formulation may further comprise a second particulate plastic pigment, which may be in the form of solid or vacuolated particles of varying size, for example from about 0.20 to about 0.45 micron in diameter. This second pigment may be blended with the first particulate plastic pigment to provide optimal light-scattering properties, such as opacity, without loss of bulk and gloss.

The coating formulation may additionally contain ground or precipitated calcium carbonate as a pigment. Examples of such materials include HYDROCARB 90 and COVERCARB, supplied commercially by Omya, and ALBAGLOSS S, available from Specialty Minerals Inc. Typically, up to about 90 parts by weight of calcium carbonate, based on the total dry weight of the dry pigment, may be added. Preferably, the amount added is from about 30 parts to about 70 parts by weight of the total weight of dry pigment.

The coating formulation may optionally also include clay as an added pigment. The brightness of the clay may be selected based on the brightness requirement for the finished product, and, accordingly, high or regular brightness clay may be used. Such clays may include No.1 or No.2 clays and kaolin clay. Examples of these are HYDRAFINE 90, available commercially from J. M. Huber Corporation, and ALPHACOTE and PREMIER No.1 from English China Clay Inc. Preferably, regular or high brightness kaolin clay is used. The amount of clay that may be added to the coating formulation of the present invention may be up to about 90 parts by weight, preferably from about 10 parts by weight up to about 40 parts by weight, based on the total weight of the dry pigment.

Other conventional additives, such as binders, opacifiers, whitening agents, pigments, starch, polyvinyl alcohol (PVA), polyvinyl acetate (PVAc), styrene-butadiene latex, carboxymethylcellulose (CMC), titanium dioxide ($TiO_2$), calcined clay, optical brighteners, tinting agents, dyes, dispersants and insolubilizers may be included in the coating formulation.

The coating formulation may be formulated by mixing together the various ingredients in a one-tank make down or by pre-mixing then combining separate ingredients. When used, starch or PVA is pre-cooked before it is combined with the other ingredients. The mixture is continually agitated to homogenize the ingredients. The resulting formulation may be of a viscosity ranging from about 1000 cPs to about 6000 cPs, preferably from about 2000 cPs to about 4000 cPs (Brookfield No.4 spindle, 20 rpm). The solids content of the coating composition when it is used, for example, in a blade coater, may desirably be as high as from about 60% to about 75% by weight; however, because the plastic pigment is typically added to the formulation in the form of an aqueous dispersion having a low solids content, the solids content of the coating formulation is more usually in the range of from about 40% to about 60% by weight. While the range of pH is limited only by the type of additives included in the formulation, it is recognized that the pH of the coating formulations may typically range from about 7 to about 10.

The coating formulation may be applied to either one side (C1S) or both sides (C2S) of a base stock substrate in an amount that, when dried, provides maximum gloss without negatively affecting print quality when the paper is printed. The coating formulation is applied at a dry coat weight of from about 2.5 to about 12 lbs./ream/side, where the ream size is about 3300 lbs/ft$^2$. Preferably the coating formulation is applied at a dry coat weight of from about 7 to about 9 lbs./ream/side on an uncoated sheet of base stock having a basis weight higher than 100 lbs./ream, and at from about 5 to about 8 lbs./ream/side on an uncoated base stock sheet of lower basis weight. The coating formulation may be applied as a single layer alone, or in multiple layers, or as the final, surface layer atop one or more other coating layers. For example, on a pre-coated sheet containing from about 3 to about 8 lbs./ream/side of a previously applied coating, the coating formulation may be applied atop the first coating, on the same side, at a coat weight of about 2 to about 9 lbs./ream/side. The total dry weight of the coating so formed may be from about 5 to about 17 lbs./ream/side, using either light or heavy basis weight substrates. Regardless of which of the foregoing options is selected, the coating formulation of the invention is preferably applied to achieve a final basis weight of from about 50 to about 200 lbs./ream in the finished product. The coating formulation may be applied by any conventionally known means, including, but not limited to, bar or rod coating, knife or doctor blade coating, roll coating, spray coating, flooding or any combination thereof. The coating formulation is preferably applied to at least one side of a base stock using a blade coater, in a substantially uniform thickness over the surface of the base stock.

Figure 1B:
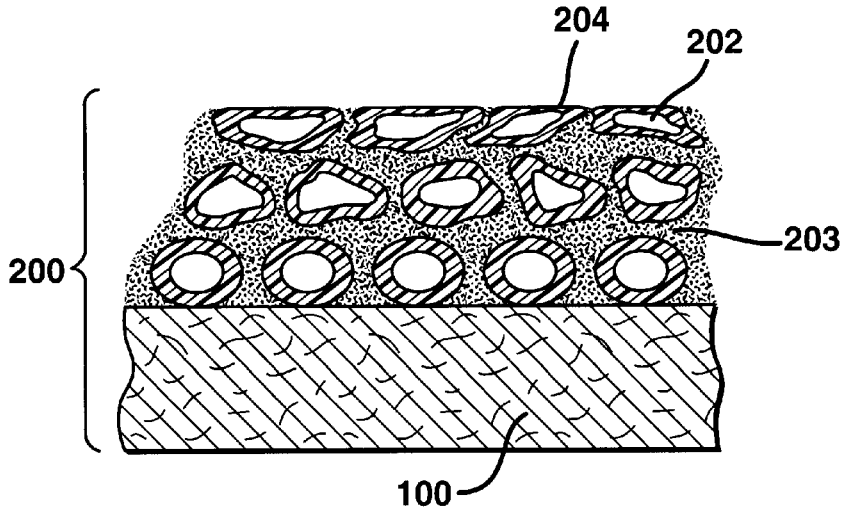
FIG. 1*b* is a cross-sectional representation of a coated base stock after calendering according to the present invention.

As represented in FIG. 1*a,* the coating formulation, when applied to the surface of a base stock 100, forms a layer comprised of hollow plastic pigment particles 201, each particle having a hollow core or vacuole 202. The remainder of the coating layer is comprised of binders, additional pigments and other additives, as described herein, which form a matrix 203 around the particles 201. After finishing, as shown in FIG. 1*b,* the particles are compressed such that the layer forms a flattened and smoothed surface 204 of the calendered product 200, thereby providing the desired gloss effect.

Figure 2:
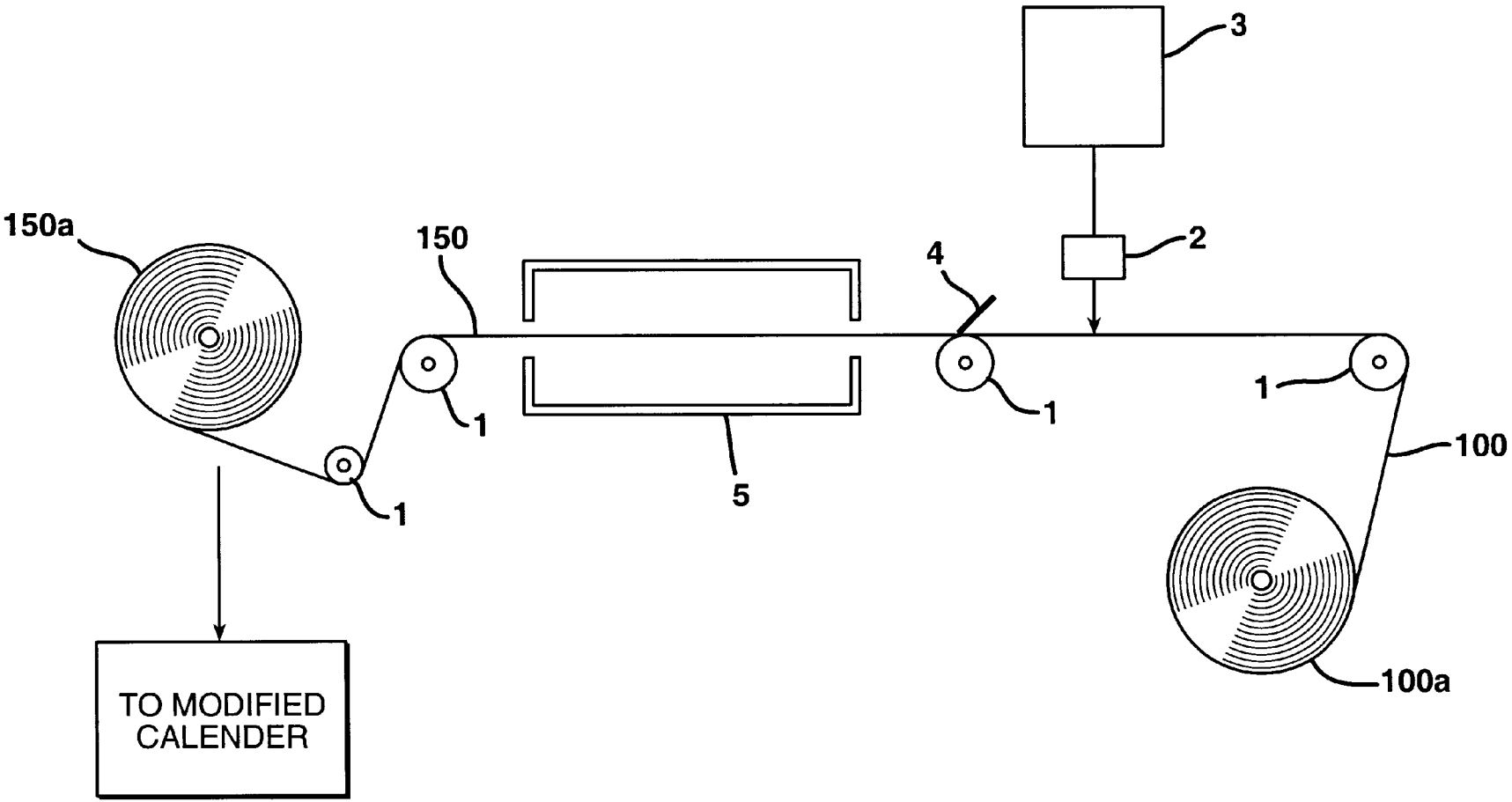
FIG. 2 is a schematic representation of a process for coating a base stock before calendering according to the invention.

Preferably, the coating process is carried out off-line or in-line. For example, as shown in FIG. 2, a web of base stock 100 may be unwound from a roll 100*a* and passed via guides 1 through a coating apparatus such as a blade coater, which may include a delivery means 2, a reservoir 3 and a metering device, for example a doctor blade 4. The delivery means 2 for transferring the coating formulation to the web may, for example, be a rotating roll, pump or gravity-fed pipe in flow communication with the reservoir 3, which, in turn, may be continually replenished from a mixing tank (not shown). The reservoir 3 is agitated constantly to maintain homogeneity of the formulation. In the coating step, the base stock 100 is contacted with the delivery means 2, whereby the coating formulation is continuously deposited on the surface of the base stock 100. Excess coating formulation is removed as the base stock 100 then passes under the doctor blade 4, which is set at an angle to the base stock 100 to provide a scraping action that removes the excess coating formulation from the surface of the base stock 100 and evenly distributes the remaining coating formulation across the surface. The angle of the doctor blade 4 may be adjusted depending on the desired thickness of the coating. After the coating is applied and the excess removed, the coated base stock 150 that is formed may then be passed or drawn through a drier apparatus 5, such as an oven, infra-red drier or other drying device, in which the coating is dehydrated and solidified onto the web surface. Any conventional oven may be used, with the operating temperature selected according to the line speed, amount and thickness of coating, the water content and the temperature sensitivity of the coating ingredients. For example, the coated base stock 150 may be passed, at a line speed of about 500 to 5000 fpm, through an oven maintained at about 200° F. to about 500° F.

Figure 3:
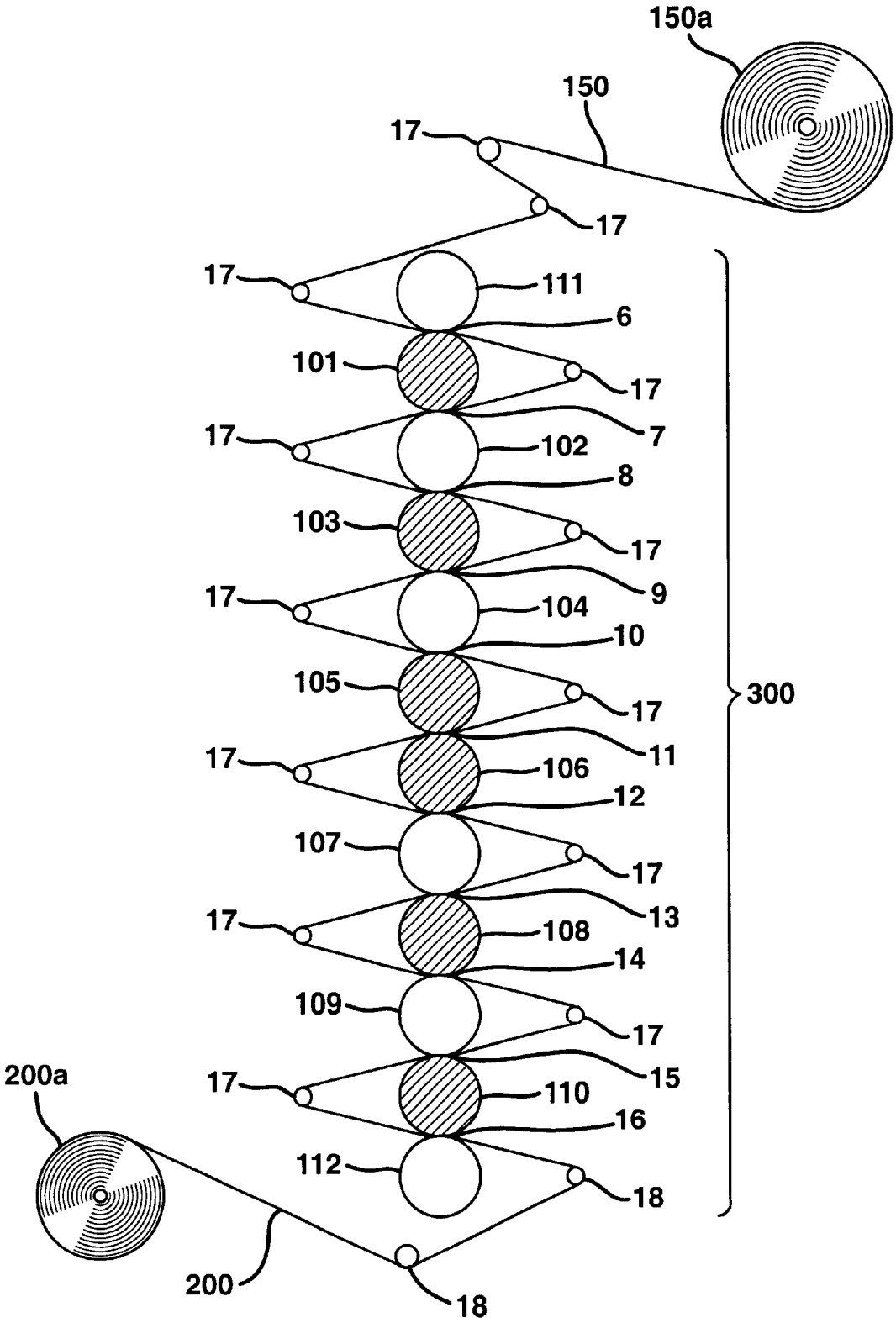
FIG. 3 is a schematic representation of a process for finishing a coated paper using a modified multi-nip calender device according to the present invention.

After the coating formulation is applied and dried, the coated base stock 150 may be collected, as in a roll 150*a* or in any other suitable form (not shown) for subsequent use. Alternatively, the coated base stock 150 may be formed and then immediately finished in an in-line process. In an exemplary embodiment, as shown in FIG. 3, the coated base stock 150 is unwound from a roll 150*a,* then drawn through a modified calender 300. Suitably, the modified calender 300 is a multi-nip supercalender comprising a linear arrangement of from 6–14 hard and soft rolls. The linear arrangement of the rolls may be vertical, inclined or horizontal. For example, in an embodiment of the invention represented by FIG. 3, such a calender is comprised of a series of intermediate rolls 101–110 that are vertically aligned between an upper roll 111 and a lower roll 112, in which the arrangement of the rolls has been modified to provide a substantially uniform load at each successive nip. As used herein, "substantially uniform" means that there is minimal variation, no more than 0–100 pli, between the nip loads measured at each nip throughout the calender. Examples of such calenders are the modified supercalenders disclosed in U.S. Pat. No. 5,438,920, the entire disclosure of which is incorporated herein by reference. By using the modified calender, it is possible to control or manipulate the load at each nip in a calender stack, and if desired, run higher loads in the top of the calender stack and lower loads at the bottom compared to conventional supercalenders. Commercial examples of such supercalenders are those manufactured commercially by Valmet, Inc. under the brand name "OPTILOAD", or by Voith Sulzer GmbH.

The modified calender 300 may be equipped with from 5 to 13 nips, preferably from 9 to 11 nips, each nip being formed between a pair of rolls. The rolls 101–112 may be either hard or soft rolls. Hard rolls 102, 104, 107, 109, 111 and 112 may typically have an outer surface formed of steel or other non-corrosive non-yielding conductive material that may be heated or chilled. The soft rolls 101, 103, 105, 106, 108 and 110 may be surfaced with a polymer coating, fiber or other pliable material. The upper, lower and intermediate rolls may typically be crown-compensated such that the load is varied across the machine width of the roll for fine-tuning of the web substrate caliper profile.

The calendering step of the present invention may be performed at line operating speeds of from about 500 to 5000 fpm, with one or more hard rolls being heated to a temperature of up to about 450° F., preferably from about 150° F. up to about 240° F. Suitably, the initial, intermediate and final nip pressures are maintained at less than about 2500 psi, as determined by the Raybestos—Manhattan modification of the Hertzian equation, as set forth in the article, Schmidlin, H. L., "Rubber Roll Hardness—Another Look," Pulp and Paper, Mar. 18, 1968, pp. 30–32; see also Deshpande, N. V., "Calculation of Nip Width, Penetration and Pressure for Contact between Cylinders with Elastomeric Covering," TAPPI October 1978, Vol. 61 No. 10, pp. 115–118. According to this formula:

$$P_n = L/n$$

$$n = [4LTD_1D_2/E(D_1+D_2)]^{1/m}$$

where $P_n$ is the specific nip pressure in pounds per square inch (psi), L is the nip load in pounds per lineal inch (pli), n is the nip width in inches, $D_1$ and $D_2$ are the diameters, in inches, of the rolls forming the nip, T is the thickness, in inches, of the soft roll cover, E is the elastic modulus of the soft roll in the nip (psi), and m is an exponential factor, which may be calculated based on the roll diameters.

Referring again to FIG. 3, the coated base stock 150 enters the modified calender 300 and is drawn through a first nip 6 set at a nip load, for example, of approximately 600 pli. This initial load may suitably be varied from about 200 to about 2500 pli, to provide the desired gloss and density. The web is subsequently passed through a series of nips 7–15, via guides 17, then through a final nip 16, the load at each nip being substantially uniform in relation to the other nips in the series.

The calendered paper product 200 may then be passed over one or more guides 18 and wound, via any conventional means, into a roll 200*a,* or otherwise packaged. The finished paper product may be subjected to any number of conventional post-finishing operations, such as printing, cutting, folding and the like, depending on the intended use.

Figure 4:
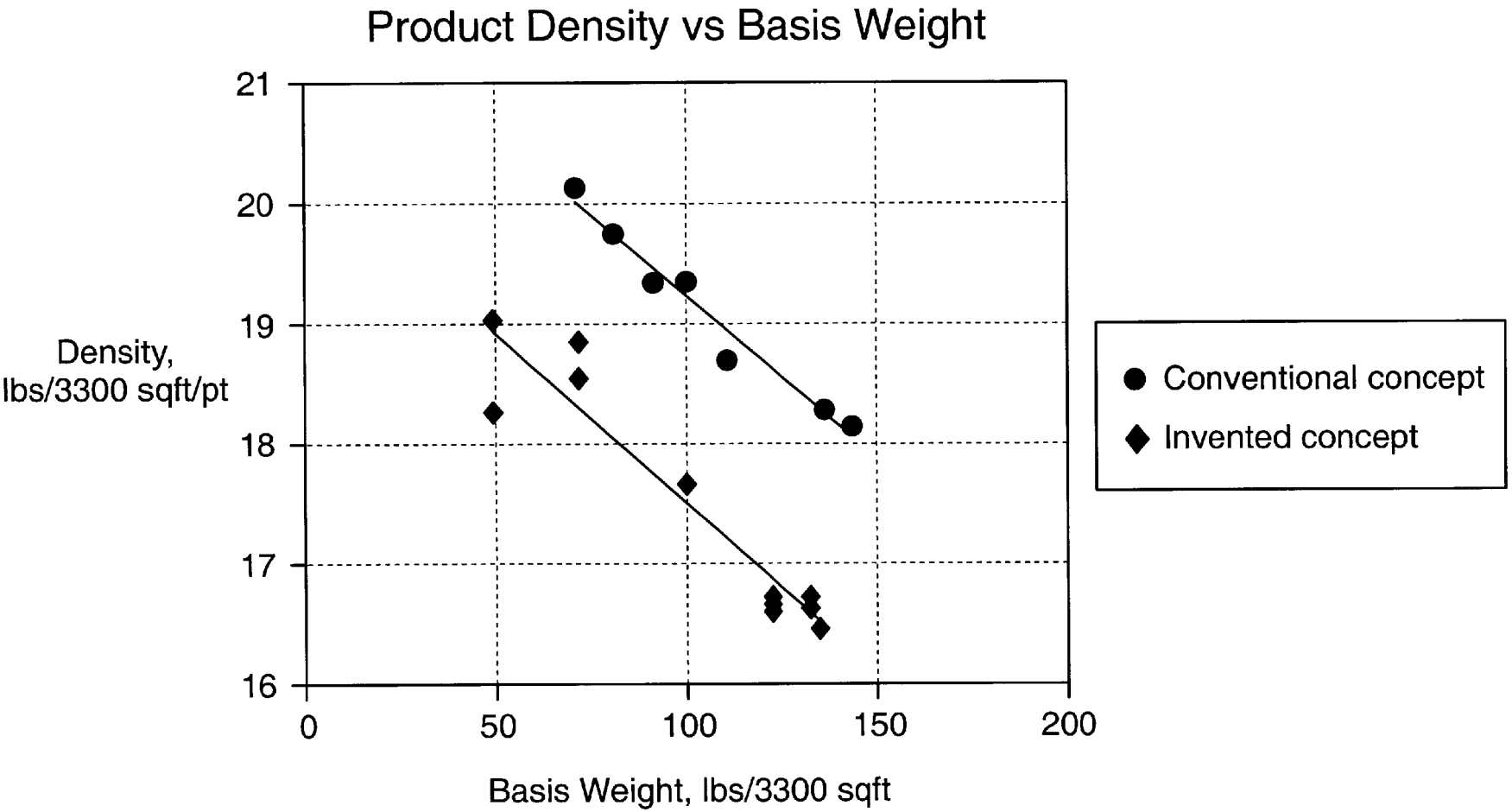
FIG. 4 is a graph showing the reduction in product density in relation to basis weight that may be achieved at constant gloss levels using the combination of the coating formulation comprising a vacuolated particulate pigment and a modified supercalendering process according to the present invention.

The use of a modified multi-nip calender in combination with the use of coating formulations containing more than 10 parts by weight of a vacuolated plastic pigment, based on the total weight of the dry coating composition, allows the papermaker to produce a bulky sheet with a high gloss surface at reduced calender loads. The invention, in this respect, may be used to produce paper products having a density ranging from about 15.5 to about 20 lbs./ream/pt, in relation to a basis weight of from about 50 lbs./ream to about 150 lbs./ream, while at the same time having a TAPPI gloss level, at 75° reflectance, of from about 60 to about 90. These results are graphically represented in FIG. 4.

The following examples are representative of, but are in no way limiting as to the scope of the present invention.

EXAMPLES

Example I

In Examples 1–4, three coating formulations A–C were prepared and coated separately or in combination onto a 37 lbs./ream base stock, which was then finished under various coating and finishing conditions. Each coating was formulated according to the recipe in Table 1, below.

TABLE 1

| Formulation | Parts by weight A | B | C |
|---|---|---|---|
| Premier[a] | 30 | | |
| KCS[b] | | 90 | |
| Alphacote[c] | 30 | | |
| Hydrocarb CC[d] | 30 | | 80 |
| HC-60[d] | | 10 | |
| Finntitan RDE2[e] | 7.5 | | |
| HP-1055[f] | 2.5 | | 20 |

[a]-# 1 clay, ECC Inc.
[b]-# 2 clay, ECC Inc.
[c]- high brightness clay, ECC Inc.
[d]- calcium carbonate, Omya Inc.
[e]- titanium dioxide, Kemira Inc.
[f]- hollow sphere styrene-acrylic plastic pigment, 1.0 micron diameter, Rohm & Haas The coating formulations were then applied to both sides of a base stock paper at a total coating weight of about 7 lbs./ream per side at a coating speed of 4500 fpm. In this regard, where multiple coatings were applied, the total coating weight was approximately 7 lbs./ream per side. The coating alternatives included: (a) applying a single layer coating on each side of the web with a jet applicator blade metering coater; or (b) applying a first coating layer of 3 lbs./ream on each side with a film coater, followed by a second top coating layer of 4 lbs./ream on each side with a jet applicator blade metering coater. Each of the coated papers was then subjected to either calendering with a conventional supercalender or a modified supercalender according to the present invention. The conventional supercalender was a 12-roll supercalender equipped with "DURAHEAT" (Valmet) roll covers, commercially available from Valmet Inc., on the soft rolls, and heated steel hard rolls. The modified supercalender was a 12-roll "OPTI-LOAD" (Valmet) modified supercalender equipped with DURAHEAT (Valmet) soft rolls and heated steel hard rolls, operated at nip loads of 132, 265, 532, 800 and 1066 pli throughout all the nips, respectively. Gloss and density of the finished product were measured and the results reported in Table 2.

TABLE 2

| SAMPLE | Formulation | Coating Means | Calendering Means | Nip Load (pli) | Nip Pressure (psi) | Density (lbs./ream/pt) | TAPPI Gloss (75°) |
|---|---|---|---|---|---|---|---|
| 1 | A | Blade | Conventional | 1155 | 2468 | 20.4 | 72.6 |
| | | | Supercalender | 1511 | 2923 | 20.4 | 75.3 |
| | | | | 1867 | 3340 | 20.6 | 78.4 |
| 2 | A | Blade | Optiload | 265 | 977 | 19.0 | 61.7 |

TABLE 2-continued

| SAMPLE | Formulation | Coating Means | Calendering Means | Nip Load (pli) | Nip Pressure (psi) | Density (lbs./ream/pt) | TAPPI Gloss (75°) |
|---|---|---|---|---|---|---|---|
| | | | Calender[X] | 532 | 1515 | 19.6 | 69.5 |
| | | | | 800 | 1959 | 20.6 | 77.8 |
| | | | | 1066 | 2347 | 20.9 | 80.3 |
| 3 | B, A* | Film + Blade | Optiload | 265 | 977 | 19.9 | 63.2 |
| | | | Calender[X] | 532 | 1515 | 20.4 | 69.5 |
| | | | | 800 | 1959 | 21.4 | 77.5 |
| | | | | 1066 | 2347 | 21.5 | 79.1 |
| 4 | B, C* | Film + Blade | Optiload | 132 | 630 | 18.2 | 67.4 |
| | | | Calender[X] | 265 | 977 | 19.2 | 84.1 |
| | | | | 532 | 1515 | 19.9 | 87.8 |

* - layers of each formulation applied in sequence shown
X - OPTILOAD model 11-nip load-modified supercalender, Valmet Paper Machinery.

These results showed that using a top coating formulation in a modified calendering process according to the invention yielded a product of approximately 50 lbs./ream basis weight, having a gloss value determined at 75° of greater than 65 and a density of less than 19 lbs./rm./pt, or, alternatively, a gloss value of 80 and a density of less than 20 lbs./rm./pt. To achieve corresponding gloss quality using a conventional coating and calendering method, a resulting sheet density higher than 20 lbs./ream/pt would be obtained.

Example II

Samples of low density 8 pt glossy cover grade (Examples 5–8) were prepared using two coating formulations, D and E, applied to a 120 lbs./ream base paper stock (Westvaco) using a Valmet blade coater. Coating formulation D was a comparative sample having a relatively minor amount of plastic pigment, which included 55 parts by weight PREMIER #1 high brightness clay (ECC), 35 parts by weight HC90 calcium carbonate (Omya), 5 parts by weight of HP-1055 hollow plastic sphere pigment (Rohm & Haas) and 5 parts by weight TIONA 4000 titanium dioxide ($TiO_2$) whitening pigment (Millennium Chemicals). Coating formulation E included 50 parts by weight ALBAGLOSS S, a precipitated calcium carbonate (Specialty Minerals), 30 parts PREMIER #1 high brightness clay (ECC) and 20 parts by weight HP-1055 hollow plastic sphere pigment (Rohm & Haas). The samples were then calendered using a conventional calender or using a modified calender according to the invention. The conventional supercalender configuration included polymer-covered DURASOFT rolls (Valmet) instead of paper or cotton soft rolls. Nip loads in the bottom nip were determined to be 1269 and 1813 pli. The modified supercalender was an OPTILOAD 12-roll model, available from Valmet Paper Machinery. The nip load in each nip was 450, 908, 1269 or 1949 pli. The resulting products were evaluated as to density and gloss. The results are shown in Table 3.

TABLE 3

| SAMPLE | Coating Formulation | Coating Means | Calendering Means | Nip Load (pli) | Nip Pressure (psi) | Density (lbs./ream/pt) | TAPPI Gloss (75°) |
|---|---|---|---|---|---|---|---|
| 5 | D (Comparative | Blade | Conventional | 1269 | 2619 | 16.7 | 50 |
| | Sample) | | Supercalender | 1813 | 3272 | 16.9 | 59 |
| 6 | D (Comparative | Blade | Optiload | 1269 | 2619 | 17.3 | 66 |
| | Sample) | | Calender[X] | 1949 | 3696 | 17.8 | 75 |
| 7 | E | Blade | Conventional | 1269 | 2619 | 16.2 | 66 |
| | | | Supercalender | 1813 | 3272 | 16.7 | 73 |
| 8 | E | Blade | Optiload | 450 | 1313 | 15.9 | 67 |
| | | | Calender[X] | 908 | 2121 | 16.4 | 75 |
| | | | | 1269 | 2619 | 17.0 | 77 |
| | | | | 1949 | 3696 | 17.7 | 80 |

X - OPTILOAD 11-nip load-modified supercalender, Valmet Paper Machinery.

The results showed that an 8 pt cover grade with a gloss of 75 (TAPPI 75°) and a density below 16.5 pounds per ream per caliper point (lbs./rm./pt) was produced using a coating containing approximately 20 parts by weight of a hollow sphere plastic pigment in a multi-nip calender operating at reduced nip pressure.

Many variations and modifications of the invention will become obvious to those skilled in the art once presented with the disclosure herein. Accordingly it will be understood that all such embodiments that are within the scope of the appended claims are intended to be encompassed by the present disclosure and claims.

We claim:

1. A method of producing a finished paper or paperboard having high gloss and high bulk comprising the steps of:

forming a base stock;

coating at least one side of the base stock with a coating comprising a vacuolated particulate plastic pigment; and passing the coated base stock through a multi-nip calender device, wherein said calender device comprises at least three or more hard rolls and at least three or more soft rolls in an alternating arrangement, the interface between one hard roll and one soft roll forming at nip, wherein said calender device has at least five nips and a means to maintain a nip load on the coated base stock at the first nip of about 1000 pounds per linear inch or less and a nip load on the coated base stock at each of the succeeding nips of about 1000 pounds per linear inch and wherein the surface temperature of each hard roll does not exceed about 450° F. to form a product having a TAPPI 75° gloss value of greater than 60 with a density range of about 15.5 pounds per ream per caliper point at a basis weight of about 150 pounds per ream to a density of about 20 pounds per ream per caliper point at a basis weight of about 50 pounds per ream.

2. The method of claim 1 wherein the multi-nip calender device comprises less than 14 nips.

3. The method of claim 1, wherein the base stock is formed from a paper furnish including a pulp comprised of less than 60% weight mechanical pulp.

4. The method of claim 1, wherein the one or more hard rolls is heated to a temperature of up to about 240° F.

5. The method of claim 1, further comprising applying multiple layers of the coating formulation on the same side of the base stock as the first coating layer before it is passed through the multi-nip calender device.

6. The method of claim 1, wherein the coating formulation is applied at a weight of from about 2.5 lbs./ream/side to about 12 lbs./ream/side, based on the total dry weight of the coating formulation.

7. The method of claim 1, wherein the vacuolated particulate plastic pigment has an average diameter of up to about 1.0 micron.

8. The method of claim 1, wherein the coating formulation comprises a second particulate plastic pigment selected from the group consisting of hollow or solid particulate pigments having a diameter of from about 0.2 microns to about 0.45 microns.

9. The method of claim 1, wherein the particulate plastic pigment is present in an amount of from about 10 parts by weight to about 50 parts by weight, based on the total dry weight of pigment in the coating formulation.

10. The method of claim 1, wherein the coating formulation further comprises calcium carbonate in an amount of up to about 90 parts by weight, based on the total dry weight of pigment in the coating formulation.

11. The method of claim 1, wherein the coating formulation further comprises high brightness clay in an amount of up to about 90 parts by weight, based on the total dry weight of pigment in the coating formulation.

12. The method of claim 1 wherein the nips of said multi-nip calender devices are no horizontal with each other.

13. The method of claim 1 wherein the nips of said multi-nip calendar devices are about vertical to each other.

* * * * *